United States Patent [19]

Cooper

[11] Patent Number: 4,851,384

[45] Date of Patent: Jul. 25, 1989

[54] RECORD MATERIAL

[75] Inventor: John B. Cooper, High Wycombe, England

[73] Assignee: The Wiggins Teape Group Limited, Basingstoke, United Kingdom

[21] Appl. No.: 858,695

[22] Filed: May 2, 1986

[30] Foreign Application Priority Data

May 2, 1985 [GB] United Kingdom ..... 8511202

[51] Int. Cl.[4] ..... B41M 5/22

[52] U.S. Cl. ..... 503/209; 427/150; 428/914; 503/214; 503/219; 503/225

[58] Field of Search ..... 346/209, 219, 225; 427/150–152; 428/914; 503/214

[56] References Cited

U.S. PATENT DOCUMENTS

| | | | |
|---|---|---|---|
| 3,029,154 | 4/1962 | Kapral | 428/537.5 |
| 3,243,312 | 3/1966 | Schutzner et al. | 503/225 |
| 3,416,942 | 12/1968 | Schutzner et al. | 503/225 |
| 3,663,483 | 5/1972 | Steele | 503/225 |
| 3,674,535 | 7/1972 | Blose et al. | 503/225 |
| 3,746,675 | 7/1973 | Blose et al. | 503/225 |
| 3,767,449 | 10/1973 | Hayashi et al. | 503/225 |
| 3,772,052 | 11/1973 | Kimura et al. | 503/225 |
| 3,911,171 | 10/1975 | Janssens et al. | 503/216 |
| 3,950,600 | 4/1976 | Knirsch et al. | 503/225 |
| 3,957,288 | 5/1976 | Lemahieu et al. | 503/216 |
| 3,965,282 | 6/1976 | Janssens et al. | 503/216 |
| 3,988,501 | 10/1976 | Knirsch et al. | 503/225 |
| 4,011,352 | 3/1977 | Janssens et al. | 503/216 |
| 4,032,690 | 6/1977 | Kohmura et al. | 503/216 |
| 4,138,522 | 2/1979 | Ishizuka et al. | 428/480 |
| 4,321,092 | 3/1982 | Cespon | 503/225 |
| 4,342,043 | 7/1982 | Palermiti et al. | 503/225 |
| 4,348,234 | 9/1982 | Cespon | 427/150 |
| 4,397,483 | 8/1983 | Hiraishi et al. | 427/151 |
| 4,461,496 | 7/1984 | Ludwig | 503/225 |
| 4,507,670 | 3/1985 | Motosugi et al. | 503/219 |

FOREIGN PATENT DOCUMENTS

| | | | |
|---|---|---|---|
| 93208 | 4/1982 | European Pat. Off. | 503/225 |
| 0120972 | 5/1983 | European Pat. Off. | 503/225 |
| 102320 | 8/1983 | European Pat. Off. | 503/225 |
| 1421467 | 10/1968 | Fed. Rep. of Germany | 503/225 |
| 2259018 | 5/1973 | Fed. Rep. of Germany | 503/225 |
| 2436097 | 2/1975 | Fed. Rep. of Germany | 503/225 |
| 372910 | 11/1983 | Fed. Rep. of Germany | 503/225 |
| 2073470 | 12/1970 | France | 503/225 |
| 2101624 | 3/1972 | France | 503/225 |
| 2113223 | 6/1972 | France | 503/225 |
| 2238596 | 7/1974 | France | 503/225 |
| 2302200 | 2/1976 | France | 503/225 |
| 8133757 | 2/1985 | Japan | 503/209 |
| 1002723 | 8/1965 | United Kingdom | 503/225 |
| 1123197 | 8/1968 | United Kingdom | 503/209 |
| 1283446 | 7/1972 | United Kingdom | 503/225 |
| 1294430 | 10/1972 | United Kingdom | 503/225 |
| 1308016 | 2/1973 | United Kingdom | 503/225 |
| 1364736 | 8/1974 | United Kingdom | 503/225 |
| 1402270 | 8/1975 | United Kingdom | 503/225 |
| 1414636 | 11/1975 | United Kingdom | 503/225 |
| 1472580 | 5/1977 | United Kingdom | 503/225 |
| 1477195 | 6/1977 | United Kingdom | 503/209 |
| 1479476 | 7/1977 | United Kingdom | 503/225 |
| 1479542 | 7/1977 | United Kingdom | 503/216 |
| 1497663 | 1/1978 | United Kingdom | 503/209 |
| 1506813 | 4/1978 | United Kingdom | 503/225 |
| 2007858 | 10/1978 | United Kingdom | 503/209 |

*Primary Examiner*—Bruce H. Hess

*Attorney, Agent, or Firm*—Burns, Doane, Swecker & Mathis

[57] ABSTRACT

A long chain fatty acid salt, for example calcium, sodium or aluminium stearate, is included in small amounts (e.g. 2 to 10% by weight) in an otherwise conventional color developer composition of which the major active ingredient is an adsorbent inorganic material. Record material coated with such a composition exhibits better sheet-fed runnability characteristics in wet offset printing operations than if the fatty acid salt is not present.

6 Claims, No Drawings

RECORD MATERIAL

This invention relates to record material carrying a colour developer composition for use in pressure-sensitive record sets (or carbonless copying paper as such sets are more usually known).

A colour developer composition, as is well-known in the art, is a composition which gives rise to a coloured species on contact with a colourless solution of a chromogenic material (such chromogenic materials are also called colour formers).

Pressure sensitive record sets may be of various types. The commonest, known as the transfer type, comprises an upper sheet (hereafter referred to as a CB or coated back sheet), coated on its lower surface with microcapsules containing a solution in an oil solvent of at least one chromogenic material and a lower sheet (hereinafter referred to as a CF or coated front sheet) coated on its upper surface with a colour developer composition. If more than one copy is required, one or more intermediate sheets (hereafter referred to as CFB or coated front and back sheets) are provided, each of which is coated on its lower surface with microcapsules and on its upper surface with colour developer composition. Pressure exerted on the sheets by writing or typing ruptures the microcapsules thereby releasing chromogenic material solution on to the colour developer composition and giving rise to a chemical reaction which develops the colour of the chromogenic material and so produces an image.

In another type of pressure-sensitive record set, known as the self-contained or autogeneous type, both the microcapsules containing the chromogenic material and the colour developer composition are present in juxtaposition in or on the same sheet.

Such pressure-sensitive record sets have been widely disclosed in the patent literature. For example, transfer sets are described in U.S. Pat. No. 2,730,456, and self-contained sets are described in U.S. Pat. No. 2,730,457.

A wide range of materials, both organic and inorganic, has been proposed for use as active ingredients in colour developer compositions. Of these, organic materials such as phenol-formaldehyde novolak resins and salicylic acid derivatives and adsorbent inorganic materials such as acid-washed montmorillonite clays have achieved widespread commercial success.

In commercial use, pressure-sensitive record sets are normally pre-printed into business forms sets, i.e. the various sheets of paper making up the set are printed before assembly into the set. Thus a very important requirement of the paper to be used in the sets is that it should have excellent printability characteristics, both as regards the quality of the print obtained and the ease, speed and convenience of the printing operation itself.

Printing of carbonless copying papers for use in business forms sets is conventionally carried out by a variety of printing techniques, one of the most important of which is sheet-fed wet offset litho printing. In this technique, individual sheets to be printed are fed in rapid succession from a stack on the feed side of the printing press past the printing plate roll and on to a collection stack on the output side of the press. Both ink and water are applied to the printing plate roll which selectively accepts the ink on part of its surface only whilst accepting water on the remaining part of the surface.

If the printing operation is to be efficient, it is essential that there should be no jamming or double feeding of the sheets, and that after the sheets have been printed, they should form a neat upright symmetrical stack, i.e. there should be a minimum of sheets which protrude beyond the mass of the stack on its leading, trailing or side edges. In the event that this is not achieved as the stack is formed, the stack should be capable of being easily and rapidly jogged mechanically into a neat upright symmetrical stack with no protruding sheets. It is also important that the sheets in the stack should exhibit the minimum amount of curl. Poor stacking performance or very bad curl will restrict the speed of operation of the printing press, and will also hinder subsequent collation of the printed sheets, possibly leading to an economically disadvantageous need for a separate collating operation.

It is found in general that CF and CFB sheets utilizing adsorbent inorganic materials as the active ingredients of their colour developer compositions give rise to more serious problems with sheet-fed wet offset litho printing than do similar sheets utilizing organic active ingredients.

It has now been found that the problems outlined above in relation to sheet-fed wet offset litho printing of CF and CFB sheets utilizing a colour developer composition having adsorbent inorganic active ingredients can be reduced or even eliminated if the colour developer composition contains a long-chain fatty acid salt, i.e. a fatty acid salt having a minimum of around 12 carbon atoms. The presence of such a long chain fatty acid salt material has been found not to impair the reactivity of the colour developer composition (the last-mentioned factor is of course of crucial significance in relation to any material being considered for use as an additive to a colour developer composition).

Long chain fatty acid salts have previously been proposed for use in certain types of colour developer compositions. For example, UK Patent No. 1,283,446 discloses the use of calcium stearate as a coating lubricant in a colour developer composition having a phenolic resin as the major colour developing ingredient. UK Patent No. 1,364,736 discloses the use of metal salts of organic acids as stabilizers in colour developer compositions of which the major active ingredient is a metal salt of a polymer which is a reaction product of an aromatic carboxylic acid or anhydride and an aldehyde or acetylene. The metal salts which may be used as stabilizers include long chain fatty acid salts. UK Patent Nos. 1,472,580 and 1,506,813 and European Patent Application No. 93208A all disclose the use of stearates in colour developing compositions which rely on the use of zinc chloride or another metal chloride for colour generation. European Patent Application No. 101320A discloses the use of metallic soaps for improving the speed of image formation of colour developing systems which rely on the use of nickel salts and di-thio oxamides for colour generation. Long chain fatty acid salts have also previously been proposed for use in thermographic papers (see for example UK Patent Nos. 1,294,430, 1,402;270, 1,479,476 and 1,479,542 and U.S. Pat. No. 3,988,501) and in coated printing papers (see for example UK Patent No. 1,123,197). Despite the foregoing disclosures, it has not previously been appreciated that the use of long chain fatty acid salts could solve the long-standing problems encountered with sheet-fed wet offset litho printing of record papers carrying colour developer compositions having an adsorbent inorganic active ingredient (zinc chloride, though inorganic in nature, does not have adsorbent properties). It should be noted in this regard that the sheet-fed runnability performance of record papers carrying colour developer compositions having adsorbent inorganic active ingredients is normally much worse than that of standard clay-coated printing papers.

The present invention therefore provides record material carrying a colour developer composition of which the major active ingredient is an adsorbent inorganic material, characterized in that the composition contains a long chain fatty acid salt.

The adsorbent inorganic active material may for example be an acid clay, for example an acid-washed montmorillonite clay, such as that disclosed in UK Patent No. 1213835, a hydrated silica/hydrated alumina composite as disclosed in European Patent Applications Nos. 42265A and 42266A or zirconia or a composite thereof as disclosed in UK Patent Application No. 2112159A or European Patent Application No. 81341A. In addition to the primary active ingredient, the colour developer composition may contain other ingredients such as fillers or extenders, for example kaolin, calcium carbonate or talc, pH adjusters such as sodium or potassium hydroxide, and a latex or other binder.

The long chain fatty acid salt is preferably a stearate, but salts of other acids may be used, for example oleates, palmitates, or linoleates. The salt may be of a metal or of a cationic species such as ammonium. The metal salt may be, for example, a calcium, zinc, aluminium, sodium or potassium salt. Whilst metal salts which are coloured are usable in principle, they are not preferred because of their colour. It is of course important that the salt chosen should not de-activate the colour developer composition. The preferred metal salt is calcium stearate.

The fatty acid salt is preferably present in the colour developer composition in an amount of from about 2 to about 5% by weight. Higher amounts may be used if desired, for example up to about 10% by weight, but this has not so far been found to give worthwhile improvements compared with lower addition levels.

The present record paper may be uncoated on its surface opposite that carrying the colour developer composition, i.e. it may be a CF paper, or it may carry a coating of microcapsules containing a solution of chromogenic material on its opposite surface, i.e. it may be a CFB paper.

The invention will now be illustrated by the following Examples, in which all parts and percentages are by weight:

EXAMPLE 1

Calcium stearate was added as a dry powder to a conventional aqueous clay colour developer formulation at a level of 2% on a dry basis. The colour developer formulation contained an acid-washed montmorillonite colour developer clay and kaolin in a ratio of 70:30, a latex binder and sufficient potassium hydroxide to make the mixture mildly alkaline. The resulting composition was blade-coated on to a paper web by means of a pilot plant coater at a dry coatweight of about 8 g $m^{-2}$. The resulting paper was then tested to assess its suitability for sheet-fed wet offset litho printing, both as regards runnability and piling, and its colour developing performance by comparison with a control paper carrying a colour developer composition which did not contain calcium stearate but was otherwise the same as the paper under test. The tests carried out and the results obtained were as follows:

(a) Sheet-fed runnability test

In this test, an A2 size ream of each of the papers being evaluated was wet-offset litho printed on a Solna printing press at 5000 impressions per hour. A video recording was made in each case of the feed and delivery ends of the press and the collection stack, and by playing the recording in slow motion a comparative assessment of feeding and delivery performance was obtained. The extent of displacement of protruding sheets in the delivery stack was also measured (an ideal result would be zero sheet displacement).

The video recording showed firstly that the feed performance of both papers was good, with the test paper being slightly better than the control paper, and secondly that the delivery performance of the test paper was markedly better than that of the control paper.

The control paper stack had a mean sheet protrusion of 10 to 20 mm at the leading and trailing edges of the stack, whereas the test paper stack had a mean sheet protrusion of only 2 to 5 mm.

(b) Printability (Piling) Test

This test assesses the amount of debris left on the printing blanket after a specified number of impressions. It was found that the test and control papers gave similar results, and it can therefore be concluded that the addition of calcium stearate does not lead to a deterioration in printability (piling) performance.

(c) Calender Intensity (CI) Test

This test involved superimposing strips of CB paper on to strips of the test and control CF papers, passing the superimposed strips through a laboratory calendar to rupture the capsules and thereby produce a colour on the CF strips, measuring the reflectance of the thus coloured strips (I) and expressing the result ($I/I_o$) as a percentage of the reflectance of unused control CF strips ($I_o$). Thus the lower the calender intensity value ($I/I_o$) the more intense the developed colour.

The reflectance measurements were done both two minutes after calendering and forty-eight hours after calendering, the sample being kept in the dark in the interim. The colour developed after two minutes is primarily due to the presence of rapid-developing chromogenic materials in the CB strips, whereas the colour after forty-eight hours derives from, slow-developing chromogenic materials also present, (fading of the colour from the rapid-developing chromogenic materials also influences the final intensity achieved).

The results obtained were as follows:

| Paper | C.I. Value ($I/I_o$) 2 min. | 48 hours |
|---|---|---|
| Test paper (with calcium stearate) | 53.1 | 41.5 |
| Control | 50.2 | 40.4 |

Although the test paper was marginally slower in developing, the final print intensities were similar, and that of the test paper was of an acceptable standard.

(d) Investigative Tests

These tests were carried out with a view to understanding why the addition of calcium stearate should improve the performance of the paper in wet offset litho printing operations, and to provide predictors of use in assessing the suitability of alternative additives for this purpose.

The tests were contact angle (measured after two seconds), coefficient of friction and "looping". The first two tests are standard physical tests requiring no further description, but the "looping" test was developed specially as an aid to assessing sheet-fed runnability.

In the "looping" test, test and control strips of paper are laid out side by side on a flat support, and are each secured to the support at one end, leaving their other ends free. A fine spray of water is then applied evenly to the strips, whilst video recording what happens. It is found that within about 4 seconds the strips, which are flat before spraying, form a loop, with the free ends of the strips retracted towards the fixed ends and the intervening paper bowing upwards. By assessing the speed of loop formation and the height of the loop formed (e.g. from the video recording re-played in slow motion) an assessment of the relative sensitivity of the two papers to moisture can be made. This is thought to be significant in assessing the suitability of the papers for wet offset litho printing, in view of the fact that papers printed by a wet offset litho technique are wetted during the printing operation.

The results were as follows:

| Nature of Test | Paper | |
|---|---|---|
| | Test | Control |
| Contact angle | 75° | 66° |
| (Coefficient) - static | 0.46 | 0.59 |
| (of friction) - dynamic | 0.39 | 0.50 |
| "Looping" | The speed of loop formation and the height of the loop formed were markedly less for the test paper than for the control paper | |

These results suggest that an additive for improving the sheet fed runnability of record materials carrying a colour developer composition containing a major proportion of an adsorbent inorganic active ingredient should be such as to raise the contact angle and to lower the coefficient of friction of the paper and to give rise to improved "looping" behaviour.

EXAMPLE 2

This illustrates the use of calcium stearate, sodium stearate and aluminium stearate at an addition level of 3% in a colour developer composition otherwise as described in Example 1. The procedure carried out and the testing of the resulting coated papers were generally as described in Example 1, except that calcium stearate was added to the colour developer formulation in 50% aqueous slurry form, rather than as a dry powder. The sodium and aluminium stearates were added as dry powders.

(a) Sheet-fed runnablity test

The control paper stack had a mean sheet protrusion of about 8 mm at the leading and trailing edges of the delivered stack, whereas the mean sheet protrusion for the papers containing either calcium or sodium stearate was only about 1 mm, and that for the paper containing aluminium stearate was only about 2 mm. The aluminium stearate paper exhibited the best feed characteristics, followed by the calcium stearate paper, the control paper and the sodium stearate paper in that order.

(b) Printability (piling test).

All these papers containing stearates gave better printability than the control sheet, the order of best performance being sodium stearate, followed by calcium stearate, followed by aluminium stearate.

(c) Calender Intensity (CI) test

The results were as follows:

| Paper | C.I. Value ($^I/_{\rho}$) | |
|---|---|---|
| | 2 min. | 48 hours |
| Calcium stearate | 47.3 | 38.4 |
| Sodium stearate | 47.0 | 39.0 |
| Aluminium stearate | 45.0 | 37.7 |
| Control | 45.7 | 38.2 |

It will be seen that there was little difference between the control and the stearate-containing papers.

(d) Looping Test

All stearate-containing papers gave less loop formation than the control paper. The aluminium and calcium stearate papers showed the least looping.

(e) Coefficient of Friction/Contact Angle

The results were as follows:

| Paper | Coefficient of Friction | | Contact Angle (°) |
|---|---|---|---|
| | Dynamic | Static | |
| Control | 0.46 | 0.56 | 88 |
| Calcium stearate | 0.41 | 0.54 | 88 |
| Sodium stearate | 0.34 | 0.48 | 83 |
| Aluminium stearate | 0.48 | 0.57 | 89 |

These results do not entirely accord with the behaviour which might be predicted from the corresponding results from Example 1, but bearing in mind the results obtained in Examples 3 and 4, which corroborate those of Example 1, it is thought that the above results may be anomalous in some respects.

EXAMPLE 3

This illustrates the use of calcium stearate and aluminium stearate at higher addition levels (5% in the case of calcium stearate and 5% and 8% in the case of aluminium stearate), and the effect of applying a coating of microcapsules to the other surface of the paper to produce a CFB product.

The colour developer composition was made up and coated generally as described in previous Examples, except that the ratio of acid-washed montmorillonite to kaolin was approximately 75:25. The calcium stearate was added as a 50% aqueous slurry, and the aluminium stearate as an almost dry powder.

The microcapsule coating composition was of the kind conventionally used for carbonless copying paper. In addition to microcapsules, it contained binders and two conventional agents for preventing premature microcapsule rupture, namely wheatstarch particles and a ground cellulose fibre floc. The composition was applied by a roll coating technique of the kind conventional for this purpose at a coatweight (when dry) of about 4 g $m^{-2}$.

The paper was subjected to the tests described in previous examples (using two different clay CF controls and two different clay CF CFB sheets as controls).

The results were as follows:

(a) Sheet-fed runnability test

The papers containing 5% calcium stearate and 5% aluminium stearate gave the best performance.

The two controls and the paper containing 8% aluminium stearate were comparable in performance. In view of the pattern of results on stearate addition generally in other Examples, and the good result obtained with 5% aluminium stearate addition, the fact that an improvement was not seen with 8% aluminium stearate addition is surprising, and may therefore be anomalous.

(b) Printability (piling test)

The 5% calcium stearate sheet showed the best printability, being substantially better than the control sheet. The 5% aluminium stearate sheet was comparable to the control. The 8% aluminium stearate sheet was worse than the control.

(c) Calendar Intensity (CI) test

This was performed in two ways, firstly with the CB surface of the CFB sheet in contact with the CF surface of another sheet of the same CFB paper, and secondly with the CB surface in contact with CF paper which had not been coated with microcapsules.

The results were as follows:

| | C.I. Value ($I/I_0$) | | | |
|---|---|---|---|---|
| | CFB to CFB | | CFB to CF | |
| Paper | 2 min. | 48 hours | 2 min. | 48 hours |
| Control I | 50.6 | 26.0 | 47.6 | 41.5 |
| Control II | 58.3 | 34.5 | 48.3 | 42.0 |
| 5% calcium stearate | 56.4 | 30.5 | 51.7 | 42.9 |
| 5% aluminium stearate | 54.8 | 28.3 | 51.4 | 44.8 |
| 8% aluminium stearate | 49.8 | 27.5 | 49.7 | 43.7 |

The results exhibit a degree of scatter, but generally it can be concluded that the inclusion of the stearates does not give rise to an unacceptable deterioration in copy-forming ability.

(d) Looping test

The order of least looping (i.e. best performance) was as follows: 5% calcium stearate, 5% aluminium stearate, 8% aluminium stearate and lastly, the two control papers.

(e) Coefficient of Friction/Contact Angle

The results were as follows:

| | Coefficient of Friction | | Contact |
|---|---|---|---|
| Paper | Dynamic | Static | Angle (°) |
| Control | 0.46 | 0.59 | 85 |
| 5% calcium stearate | 0.31 | 0.44 | 87 |
| 5% aluminium stearate | 0.35 | 0.49 | 91 |
| 8% aluminium stearate | 0.37 | 0.51 | 94 |

EXAMPLE 4

In this example, CFB paper containing 5% calcium stearate in the colour developer coating was produced on a full-size paper-making and -coating machine. The colour developer composition and microcapsule coating compositions were formulated and coated as generally described in previous Examples. Samples of the CFB paper produced, and of the CF paper produced prior to coating with microcapsules, were subjected to the tests described in Example 1. A control paper was also tested.

The test results were as follows:

(a) Sheet-fed runnability test

The CFB paper containing calcium stearate and the control CFB paper were assessed in a series of print trials. Taking the results as a whole, the paper containing calcium stearate was judged better than the control paper with respect to its delivery performance.

Since the CF paper tested was constituted by small samples from ends of reels, it was not properly sheeted, and no sheet fed runnability tests were therefore carried out using it.

(b) Printability (piling test)

The test and control CFB papers gave comparable performance.

The printability test was not carried out for the CF same reason as explained in (a) above.

(c) Calender Intensity (C.I. Test)

The results were as follows:

| | Calender Intensity | |
|---|---|---|
| Paper | 2 min. | 48 hours |
| Control (CFB) | 54.4 | 42.1 |
| 5% calcium stearate (CFB) | 52.9 | 42.4 |
| Control (CF) | 44.2 | 38.4 |
| 5% calcium stearate (CF) | 44.0 | 38.2 |

N.B. The C.I. results for the CFB sheets were obtained by placing the CB surface of the CFB sheet in contact with the CF surface of another sheet of the same CFB paper.

It will be seen that the inclusion of 5% calcium stearate did not lead to a deterioration in copy-forming ability.

(d) Looping Test

This was carried out on the CFB paper only. It was observed that the speed of loop formation and the height of the loop were less for the paper containing calcium stearate than for control CFB paper.

(e) Coefficient of Friction/Contact Angle

The results were as follows:

| | Coefficient of Friction | | Contact |
|---|---|---|---|
| Paper | Dynamic | Static | Angle (°) |
| Control (CFB) | 0.41 | 0.63 | 88 |
| 5% calcium stearate (CFB) | 0.34 | 0.57 | 92 |
| Control(CF) | 0.47 | 0.55 | 85 |
| 5% calcium stearate (CF) | 0.38 | 0.47 | 91 |

I claim:

1. Record material for use in a pressure-sensitive record set, said record material carrying the dry residue of an aqueous colour developer composition of which the major active ingredient is an adsorbent inorganic material, wherein said composition contains a long chain fatty acid salt and a latex binder.

2. Record material as claimed in claim 1 wherein said salt is a stearate.

3. Record material as claimed in claim 2 wherein said salt is calcium stearate, sodium stearate or aluminium stearate.

4. Record material as claimed in claim 2, wherein the adsorbent inorganic material is an acid clay.

5. Record material as claimed in claim 1, wherein the absorbent inorganic material is an acid clay.

6. Record Material as claimed claim 1 wherein said salt is present in an amount of from 2 to 5% by weight, based on the total weight of the colour developer composition.

* * * * *